US006414641B1

(12) United States Patent
Carlson et al.

(10) Patent No.: US 6,414,641 B1
(45) Date of Patent: Jul. 2, 2002

(54) ANTENNA DEVICE

(75) Inventors: Nicklas Carlson, Kista; Daniel Jansson, Sundbyberg, both of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/714,115

(22) Filed: Nov. 17, 2000

(30) Foreign Application Priority Data

Nov. 19, 1999 (SE) ..... 9904204

(51) Int. Cl.[7] ..... H01Q 1/24
(52) U.S. Cl. ..... 343/702; 343/700 MS
(58) Field of Search ..... 343/700 MS, 702, 343/829, 830, 846; H01Q 1/24, 1/32, 1/38

(56) References Cited

U.S. PATENT DOCUMENTS

| | | | | |
|---|---|---|---|---|
| 5,420,599 A | * | 5/1995 | Erkocevic | 343/828 |
| 5,731,791 A | | 3/1998 | Jang | 343/702 |
| 5,907,817 A | | 5/1999 | Mendolia | 455/575 |
| 5,929,812 A | | 7/1999 | Aminzadeh | 343/700 |
| 6,166,694 A | * | 12/2000 | Ying | 343/702 |
| 6,204,819 B1 | * | 3/2001 | Hayes et al. | 343/702 |
| 6,218,991 B1 | * | 4/2001 | Sanad | 343/700 MS |
| 6,225,951 B1 | * | 5/2001 | Holshouser et al. | 343/700 MS |
| 6,229,487 B1 | * | 5/2001 | Sadler et al. | 343/700 MS |

FOREIGN PATENT DOCUMENTS

| | | |
|---|---|---|
| EP | 0856907 A1 | 5/1998 |
| EP | 0867967 A2 | 9/1998 |
| GB | 2316540 A | 2/1998 |
| WO | WO 00/03452 | 1/2000 |

* cited by examiner

*Primary Examiner*—Tho Phan
(74) *Attorney, Agent, or Firm*—Volentine Francos, PLLC

(57) ABSTRACT

A more reliable contact between a radiating element and a PCB, in, e.g., a portable radio communication device, and a more reliable and simple matching of the radiating element is obtained by providing integral contacts with the radiating element and securely fastened contacts to the PCB, and with a matching element integral with the contacts and the radiating element. The dimensions of the matching element are changed to achieve a desired impedance matching of the radiating element.

24 Claims, 3 Drawing Sheets

ANTENNA DEVICE

CROSS REFERENCE TO RELATED APPLICATION

The present application is related to, and claims priority from, Swedish patent application No. 9904204-6, filed Nov. 19, 1999, the disclosure of which is specifically incorporated by reference herein in its entirety for all purposes.

FIELD OF INVENTION

The present invention relates generally to an antenna device and, particularly, to a contact used with a radiating element where the contact may be used for impedance matching.

BACKGROUND

Integral contacts on an internal antenna are often used to reduce the number of unreliable contact points in an electronic transmission system. However, the characteristics of a thin and unsupported contact can change through normal use. Thus, a problem with conventional integral contacts is that they still are unreliable and not especially robust.

Impedance matching of an internal antenna is often needed. It is desirable to have as few components as possible involved in the matching of the antenna. The more components used to achieve impedance matching the greater the likelihood is that the electrical characteristics of one will change, and thereby result in impedance mismatch.

What is needed, therefore, is a technique to affect impedance matching of antenna elements that overcome the above described shortcomings of conventional techniques.

SUMMARY OF THE INVENTION

An object of the present invention is to facilitate electrical matching of an antenna.

A further object of the present invention is to make a more reliable and durable electrical matching of the antenna.

A still further object of the present invention is to facilitate the manufacture and assembly of an antenna contact element.

These and other objects may be realized by an antenna device for a portable communication device according to the present invention, which includes a support structure, and a generally planar radiating element supported by the support structure. The antenna device further includes at least one first conductive leg connected to a ground plane device and a second conductive leg connected to a feed device, where the at least one first leg and the second leg are supported by the support structure and at a first end, which is connected to the radiating element. Moreover, a matching element is connected between the at least one first leg and the second leg. The matching element provides impedance matching.

These and other objects of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF DRAWINGS

The invention is best understood from the following detailed description when read with the accompanying drawing figures. It is emphasized that the various illustrated features are not necessarily drawn to scale. In fact, the dimensions may be arbitrarily increased or decreased for clarity of discussion. It is emphasized that the various features are not necessarily drawn to scale. In fact certain features may be increased or decreased in dimension for clarity of discussion.

DETAILED DESCRIPTION OF ILLUSTRATIVE EMBODIMENTS

In the following description, for purposes of explanation and not limitation, exemplary embodiments disclosing specific details are set forth in order to provide a thorough understanding of the present invention. However, it will be apparent to one skilled in the art that the present invention may be practiced in other embodiments that depart from these specific details. In this disclosure it is to be understood that the antenna device of the invention is operable to transmit and/or receive electromagnetic signals. Even if a term is used herein that suggests one specific signal direction it is to be appreciated that such a situation can cover that signal direction and/or its reverse, unless specifically stated otherwise.

Figure 1:
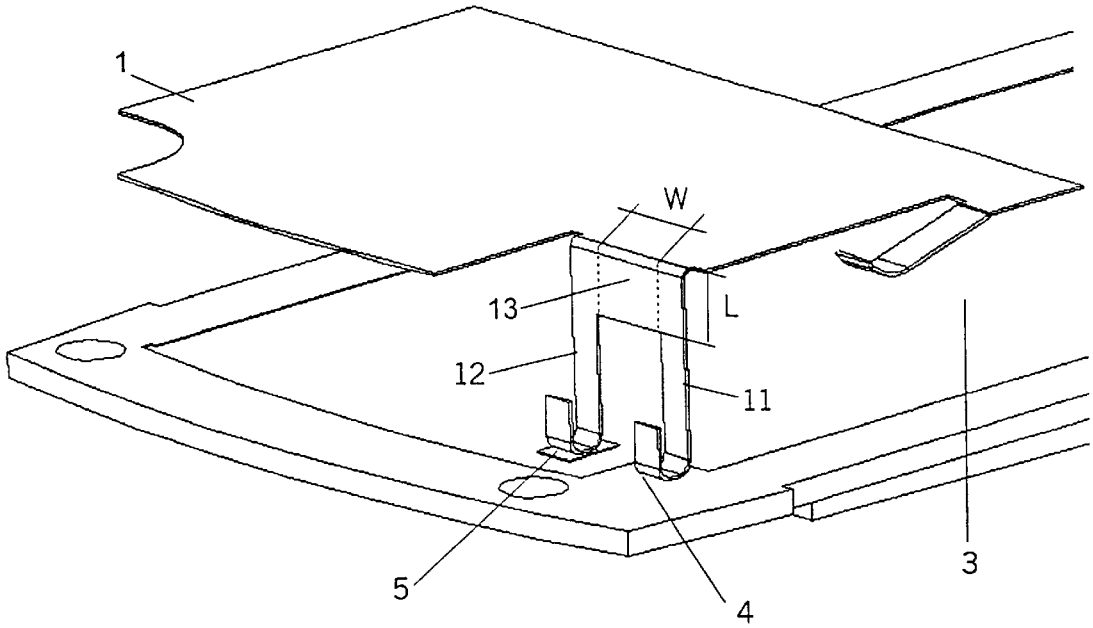
FIG. 1 shows a matching element between two integral contact legs for use in antenna according to an exemplary embodiment of the present invention.

An exemplary embodiment of the invention, used in a reliable and robust portable communication device (illustratively a mobile or portable telephone), will now be described with reference to FIG. 1. An electrical connection between a radiating element 1, illustratively a Planar Inverted F Antenna (PIFA), sheet metal or flex film, and a component of the communication device, such as a printed circuit board (PCB) 3 consists of two legs with a matching element 13 there between. The matching element 13 is illustratively integral with legs 11, 12 and the radiating element 1. The dimensions of the matching element 13 include its length L and width W, as shown. In the exemplary embodiment shown in FIG. 1, the legs 11, 12 are of equal width and consist of a grounding element 11 and a feeding element 12. The legs 11 and 12 are illustratively an integral part of the radiating element 1; with the legs (11 and 12) and radiating element 1 being manufactured as one piece, and then folded to fit in with an antenna frame 2 (shown more clearly in FIGS. 2 and 3). The ends of the legs are free and folded to be clamped between the antenna frame and the PCB 3. The PCB 3 may include receiver/transmitter electronics, illustratively radio frequency (RF) receiver/transmitter electronics. Moreover, the ground portion thereof functions as the ground plane of the antenna.

The length L and/or the width W of the matching element 13 can be varied to match the radiating element 1. This provides a matching element 13 between the legs 11, 12 that further mechanically stabilizes the legs. This variability also facilitates manufacturing and mounting of the radiating element in the portable radio communication device.

Figure 2:
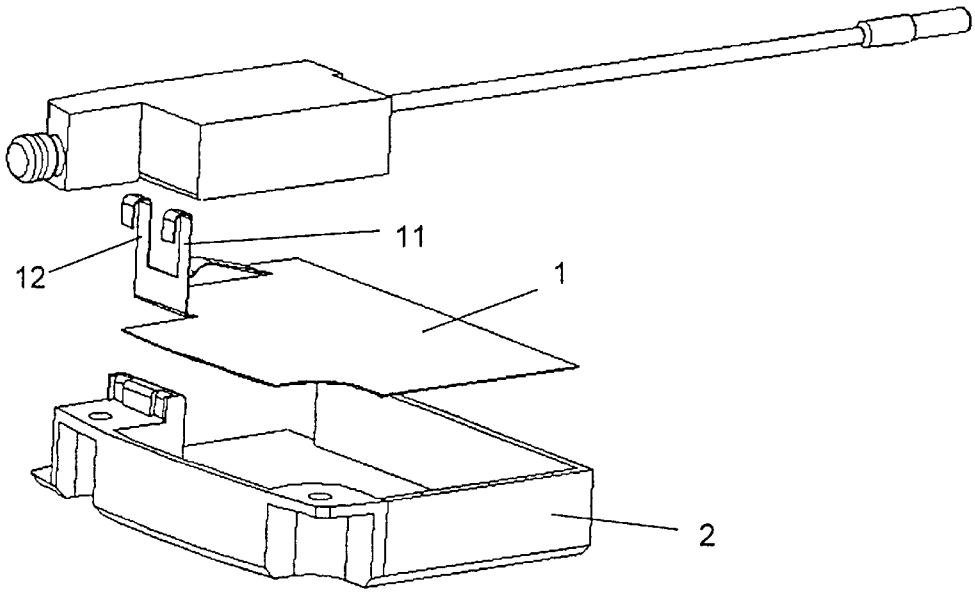
FIG. 2 shows an exploded view of the antenna device according to according to an exemplary embodiment of the present invention.
Figure 3:
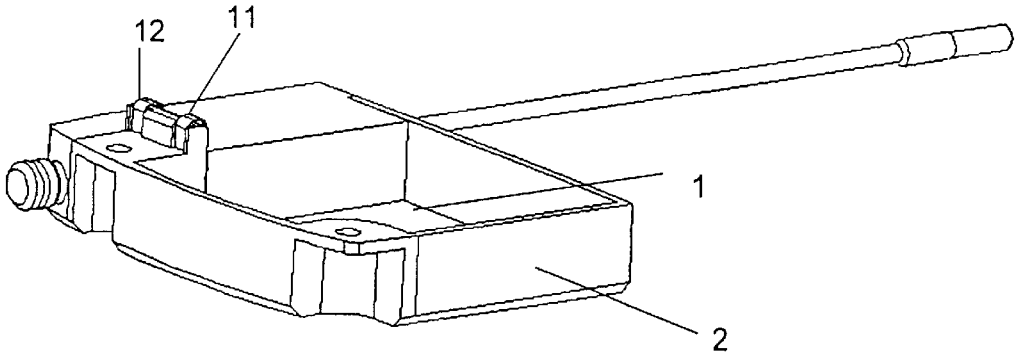
FIG. 3 shows how the legs are supported and maintained in position according to an exemplary embodiment of the present invention.

The antenna frame 2 is used to support the legs 11, 12 as shown in FIGS. 2 and 3. The antenna frame 2 supports the radiating element 1 and the legs 11, 12, with the legs 11, 12 generally being perpendicular to the radiating element 1. The antenna frame 2 also supports the folded free ends of the legs 11, 12. The legs 11 and 12 are connected to contact points 4, 5 on the PCB 3 (shown in FIG. 1) by this support. With the legs 11, 12 integral with the radiating element 1 and supported by the antenna frame 2 and clamped between the antenna frame 2 and the PCB 3, a precise and reliable high contact pressure is achieved.

Figure 4:
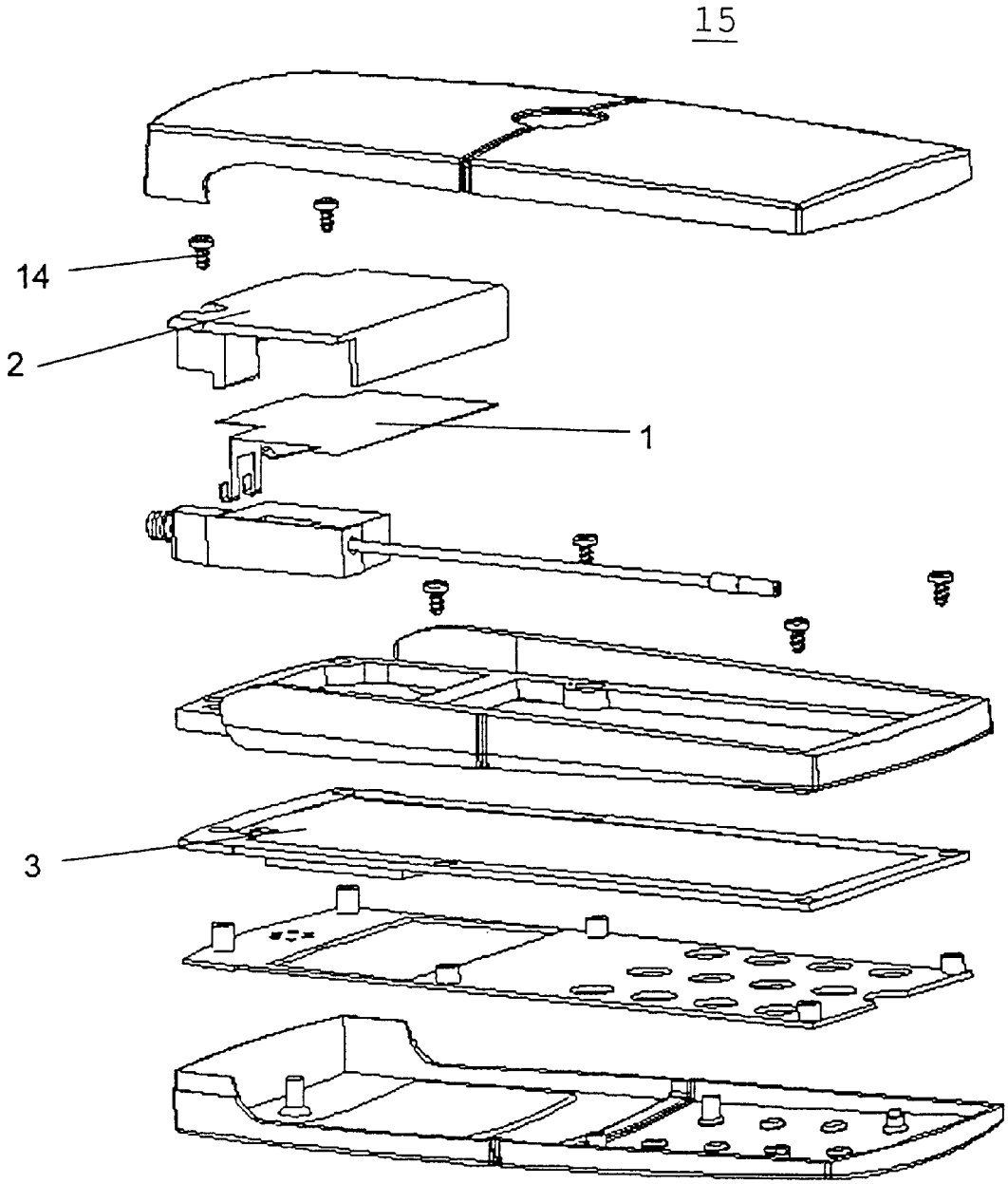
FIG. 4 shows an exploded view of a portable radio communication device incorporating an antenna device according to an exemplary embodiment of the present invention.

In FIG. 4 there is shown a portable radio communication device in the form of a mobile phone 15. The mobile phone 15 includes an antenna device according to an exemplary embodiment. The illustrative antenna device includes a radiating element 1, disposed in the mobile phone 15. The radiating element 1 is internal, and includes a generally flat conducting patch portion, shaped so as to provide desired radiating characteristics for the application in question. As already stated, in the illustrative embodiment, the radiating element 1 may be a Planar Inverted F Antenna (PIFA). The radiating element 1 is positioned between the antenna frame 2 and the PCB 3.

To clamp the free ends of the contacts 11, 12 between the antenna frame 2 and the PCB 3 a fastener, illustratively a screw 14 is used. An existing screw used to put together the portable radio communication device, may be used. The free ends of the contacts 11, 12 are clamped to the contact points 4, 5, see FIG. 1, on the PCB 3.

According to the exemplary embodiment described above, a more reliable connection between an internal antenna and a PCB in a portable radio communication device, such as a mobile or portable telephone, is achieved. As described, a contact is an integral part of the radiating element 1 and supported by the antenna frame 2 that keeps the contact in a fixed position and connected to the PCB 3. Thus, the contact includes two legs with a slit therebetween.

In addition, a simple and more reliable matching of the radiating element 1 is achieved, wherein the shape, such as length and/or width of the matching element is varied. This is advantageous over conventional techniques, where a feed element could be changed to form, form example a stepped strip. Advantageously, the invention of the present disclosure according to the exemplary embodiment makes the connection between the radiating element 1 and the PCB 3 more stable and reliable. Moreover, there are no external electric variables to take into consideration during matching. Additionally the present invention is more robust over time. Therefore, the matching is more reliable over time and less dependent on the use environment and the physical treatment of the portable communication device.

Figure 5:
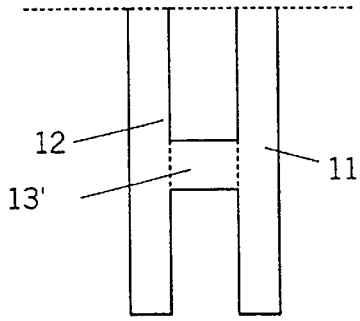
FIG. 5 shows an alternative matching element pattern according to an exemplary embodiment of the present invention.

As shown in FIG. 5, an alternative matching circuit is a bridge 13', between the legs 11, 12. The bridge is integral with both legs, but has no direct conductive connection to the radiating element 1. Besides functioning as a matching element, the bridge 13' also functions to mechanically stabilize the leg arrangement.

Finally, a few variations to the above described embodiments are worthy of explicit mention. The ground leg 11 can be made wider than the feed element 12, or narrower than the feed element 12. The folded free part of the ground leg 11 can have several contact points to the PCB. An alternative way to get several contact points to the PCB is to use several ground legs.

The position of the legs 11, 12 can also be used to tune the radiating element 1 to a desired frequency. The distance between the legs changes the tuning of the radiating element 1.

Screws have been shown as a fastener for holding the communication device together. There are also other possible fastening techniques, such as by welding or by a snap function.

The radiating element 1 has been shown with a specific shape. It is realized that it can have any suitable shape adapted for the specific requirements on the antenna element in question. Thus, although the radiating element 1 has been shown with a generally planar shape, it is realized that it can be slightly arched, thereby being adapted to the overall shape of the cover in which the antenna device is mounted.

The invention having been described in detail, it is clear that modifications and variations will become apparent to one having ordinary skill in the art having had the benefit of the present disclosure. Accordingly, such modifications and variations are included within the scope of the appended claims.

What is claimed is:

1. An antenna device for a portable radio communication device comprising:

a support structure;

a generally planar radiating element supported by said support structure;

at least one first conductive leg connected to a ground plane device and supported by said support structure, wherein a first end of said at least one first leg is connected to said radiating element, said ground plane device being a printed circuit board;

a second conductive leg connected to a feed device and supported by said support structure, wherein a first end of said second leg is connected to said radiating element; and a matching element connected between said at least one first leg and said second leg, wherein said matching element provides impedance matching of said radiating element.

2. The antenna device according to claim 1, wherein said at least one first leg and said second leg are integral with said radiating element.

3. The antenna device according to claim 2, wherein said matching element is integral with said at least one first leg and said second leg.

4. The antenna device according to claim 1, wherein said matching element is integral with said radiating element and said at least one first leg and said second leg.

5. The antenna device according to claim 1, wherein a length of said matching element provides impedance matching.

6. The antenna device according to claim 1, wherein a width of said matching element between said legs to provides impedance matching.

7. The antenna device according to claim 1, wherein a length and a width of said matching element provide impedance matching.

8. The antenna device according to claim 1, further comprising a connected bridge, disposed between said at least one first leg and said second leg, that provides impedance matching.

9. The antenna device according to claim 1, wherein only said matching element provides impedance matching of said radiating element.

10. The antenna device according to claim 1, wherein said at least one first leg and said second leg are clamped in a second end.

11. The antenna device according to claim 10, wherein said second end is folded to fit in said the support structure.

12. The antenna device according to claim 10, wherein the second end of said at least one first leg and said second leg are clamped between said support structure and said ground plane device.

13. The antenna device according to claim 10, wherein a fastening device is used to clamp said at least one first leg and said second leg.

14. The antenna device according to claim 13, wherein said fastening device is a screw.

15. The antenna device according to claim 1, wherein said at least one first leg is a ground element and said second leg is a feed element.

16. The antenna device according to claim 15, wherein said ground element is wider than said feed element.

17. The antenna device according to claim 16, wherein said ground element is wider than said feed element and is provided with several contact points to said ground plane device.

18. The antenna device according to claim 15, wherein said ground element is narrower than said feed element.

19. The antenna device according to claim 18, wherein said ground element is narrower than said feed element and is provided with several contact points to said ground plane device.

20. The antenna device according to claim 15, wherein a second end of said ground element is provided with several contact points to said ground plane device.

21. The antenna device according to claim 1, wherein a plurality of ground elements are provided to achieve several contact points to said ground plane device.

22. The antenna device according to claim 1, wherein the portable communication device is a portable telephone.

23. The antenna device according to claim 1, wherein said at least one first and said second legs are substantially perpendicular to a plane containing said radiating element.

24. The antenna device according to claim 1, wherein said generally planar radiating element is part of a planar inverted F antenna.

* * * * *